United States Patent [19]

Smith

[11] 4,017,214

[45] Apr. 12, 1977

[54] PACKING GLAND LEAK RETRIEVER DEVICE

[76] Inventor: Leonard G. Smith, 2325 Elton Ave., Bakersfield, Calif. 93306

[22] Filed: Nov. 25, 1974

[21] Appl. No.: 526,723

[52] U.S. Cl. ..... 417/9; 92/62; 92/80; 92/82; 92/86; 166/81; 277/19

[51] Int. Cl.[2] ..... F04B 49/10

[58] Field of Search ..... 92/58.1, 62, 80, 82, 92/86, 87; 277/18, 19; 166/81; 417/9, 13

[56] References Cited

UNITED STATES PATENTS

| | | | |
|---|---|---|---|
| 1,649,593 | 11/1927 | Johnson | 92/86 X |
| 1,859,393 | 5/1932 | Heitger | 92/86 X |
| 2,000,265 | 5/1935 | Vickers | 92/80 X |
| 2,136,239 | 11/1938 | Ernst | 92/80 X |
| 2,552,762 | 5/1951 | Baker | 92/80 X |
| 2,567,641 | 9/1951 | Hazelton | 92/80 X |
| 2,915,975 | 12/1959 | Kittrell | 417/9 |
| 3,163,430 | 12/1964 | Normand | 277/19 |
| 3,249,062 | 5/1966 | Coberly | 92/80 X |
| 3,279,376 | 10/1966 | Hart | 277/19 X |
| 3,529,421 | 9/1970 | Neeley | 92/80 X |
| 3,869,963 | 3/1975 | Schindel | 92/86 |

*Primary Examiner*—Alan Cohan
*Assistant Examiner*—Abraham Hershkovitz

[57] ABSTRACT

Disclosed is a leak retriever for the packing gland on oil well pumps. The leak retriever has a reservoir disposed about the packing gland to collect oil which leaks through the gland and an auxiliary pump which is mounted in the reservoir and connected to pump all oil collected back into the discharge line for the well. The auxiliary pump is mounted in the reservoir so that any leaks from the auxiliary pump are also collected by the reservoir, and is driven by a plate on the polish rod of the well pump driving apparatus. In the first form the reservoir is clamped onto the packing gland housing below the cap nut, and in the second form it is made integral with the cap nut.

9 Claims, 6 Drawing Figures

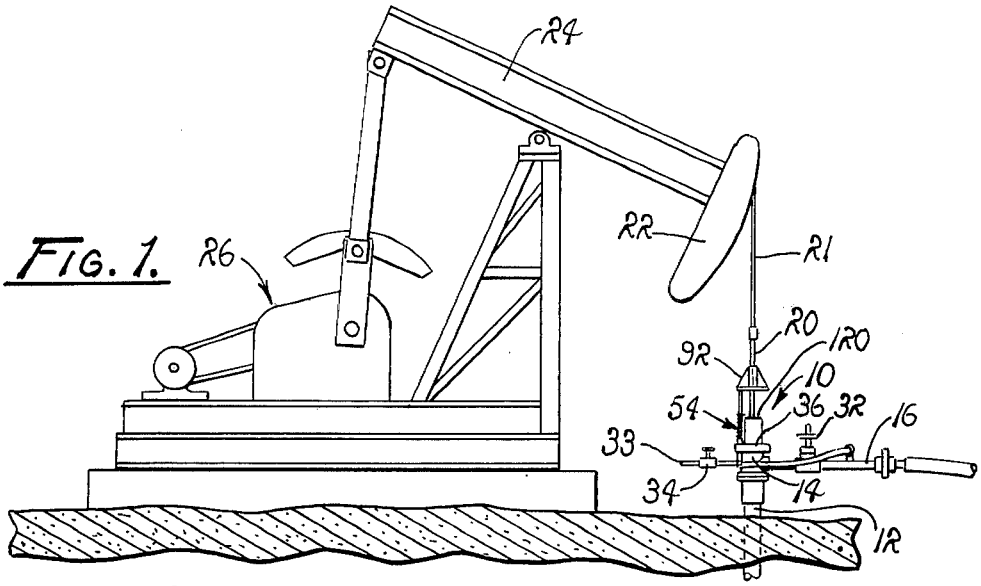
FIG. 1.
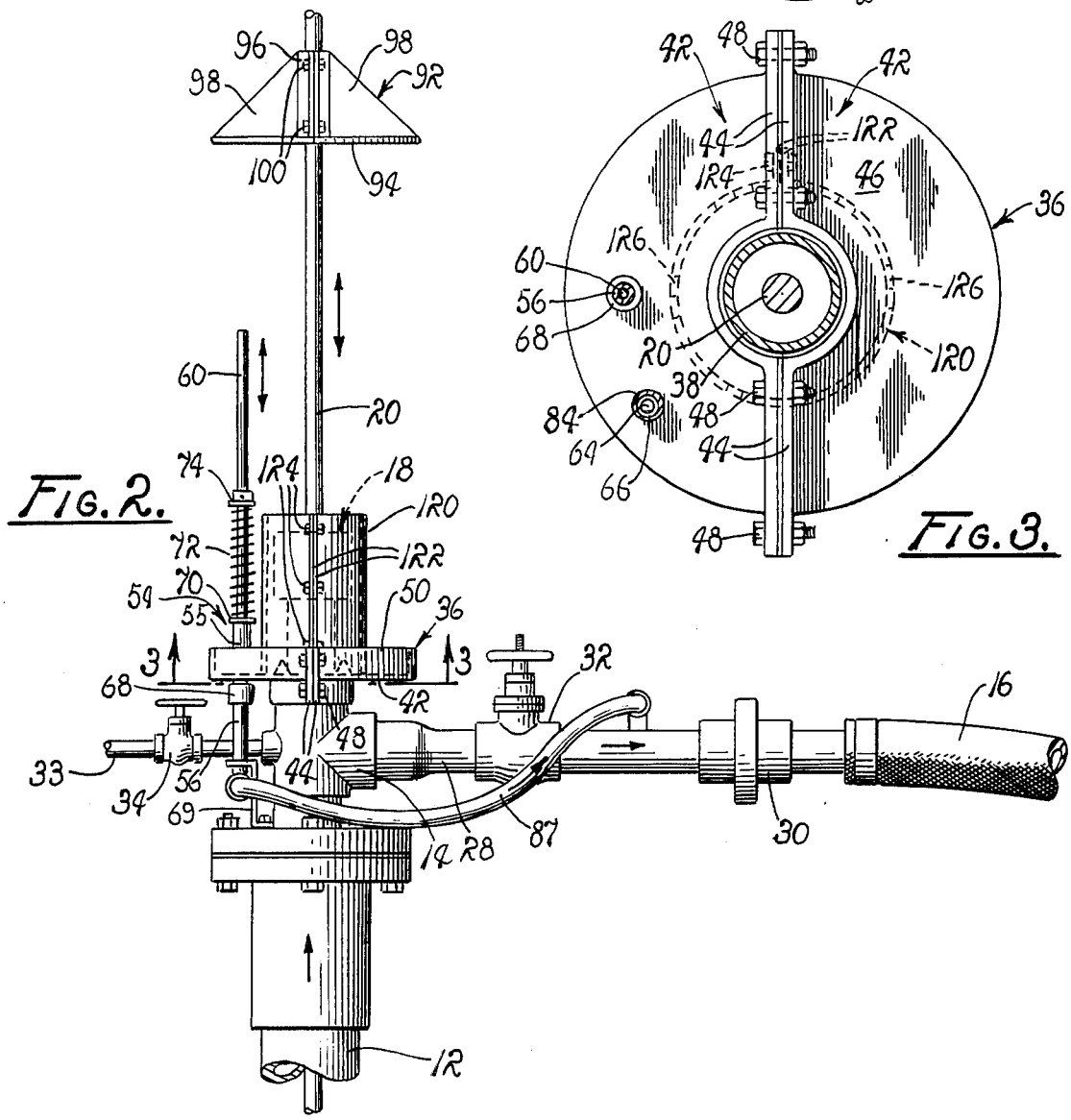
FIG. 2.
FIG. 3.

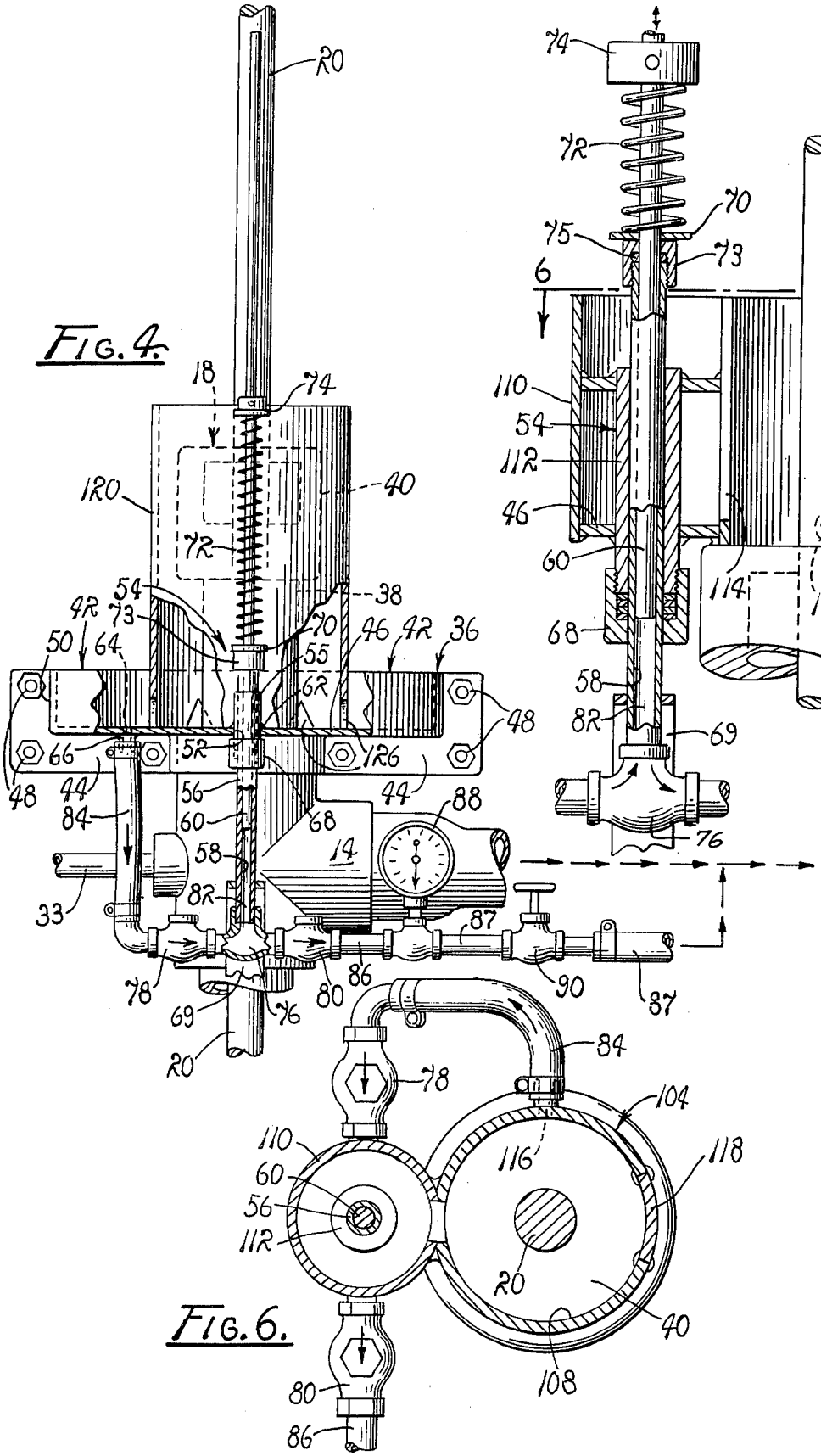
FIG. 4.
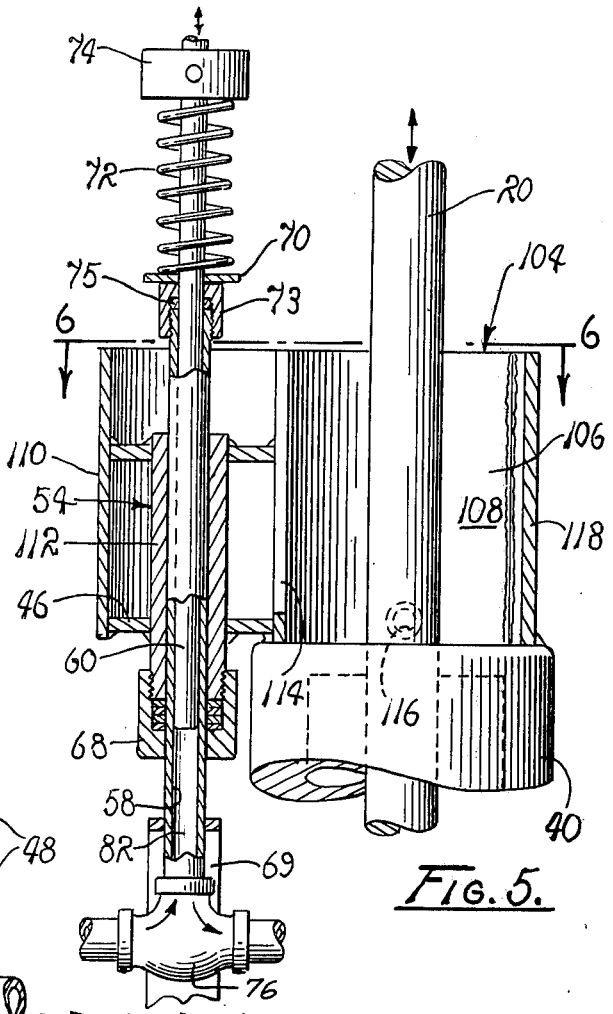
FIG. 5.
FIG. 6.

PACKING GLAND LEAK RETRIEVER DEVICE

BACKGROUND OF THE INVENTION

This invention relates generally to packing glands for oil well pumps and more particularly to improvements to such glands to prevent the leaking of oil therefrom.

In the typical oil well pump, a sucker rod extends down into the well pipe and is reciprocated in the well pipe to draw out the oil. The sucker rod is driven by a counterweighted arm pivoted by a drive motor. The sucker rod is connected to the arm by a polish rod which passes into the well pipe through a packing gland. At the top of the well, just under the packing gland, is a Tee which connects the well pipe to a discharge line that carries the output of the well to a collecting point or sump. According to older techniques the oil discharge lines were under relatively small pressure because the sumps were open. Now, due to environmental protection requirements, energy conservation, and other factors, many discharge oil lines feed closed sumps or other storage facilities and must deliver the oil under substantial pressures.

Furthermore, many wells are now being injected with steam to increase their productivity. This not only makes the oil less viscous, but it frequently causes the oil to be delivered to the surface under substantial pressure.

Even before the conditions of increased discharge line pressures occurred, leaking in packing glands was a problem. Not only was valuable oil being wasted and a messy condition being created around most well heads, but continuous maintenance was required to minimize the leaking. Now increased pressures are being created in discharge lines, and the conservation of oil and avoidance of bad environmental conditions are important considerations, this problem has been greatly accentuated.

Prior to my invention, various improvements were attempted to minimize packing gland leaks. In general, these were directed toward providing a tighter seal between the gland packing and the polish rod. Since the polish rod must continuously reciprocate in the gland, however, this approach results in faster wearout of the packing in the packing gland and increased drive motor laod because of the friction between the polish rod and the packing.

A need, therefore, exists for a better way to control oil leakage from the well packing gland.

It is a major object of my invention to provide a leak retreiver mechanism which controls packing gland leakage oil and permits increased packing gland leakage without adverse effects.

It is also an important object of my invention to control the leakage oil by retrieving it rather than preventing its leakage.

Another object of my invention is to provide a packing gland leak retriever for oil wells that is operated by the drive system of the well pump and, therefore, requires no separate power source.

A further object of my invention is to provide a packing gland leak retriever of the type described which can be installed outside of the well pipe and packing gland with minimal modifications to the well pump apparatus and negligible well shutdown time.

Still another object of my invention is to provide a packing gland leak retriever of the type described which delivers the retrieved leakage oil back into the well discharge line.

Still a further object of my invention is to provide a packing gland leak retriever of the type described which is inexpensive and relatively maintenance free.

These and other objects and advantages of my invention will become more readily apparent from the following detailed description of a preferred embodiment, and the accompanying drawings, in which:

FIG. 1 is an elevational view of above-surface portions of an oil well pump with a preferred embodiment of my invention mounted thereon;

FIG. 2 is an enlarged elevational view of a preferred embodiment of my invention shown mounted on the above ground portion of the well pipe and the packing gland;

FIG. 3 is a sectional view taken on line 3—3 in FIG. 2;

FIG. 4 is an enlarged elevational view of my preferred embodiment partially in section;

FIG. 5 is an enlarged elevational view of an alternate form of my preferred embodiment, partially in section; and FIG. 6 is a sectional view taken on line 6—6 in FIG. 5.

Referring now to the drawings and particularly FIGS. 1 through 4, the numeral 10 designates generally the preferred embodiment of my invention in its first form. My leak retriever 10 is shown mounted on the upper end of a well pipe 12 just above the tee 14 which feeds the oil discharge line 16. The packing gland 18 is located above the tee 14 and surrounds the polish rod 20. The polish rod 20 is reciprocally driven by a cable 21 attached to a horse head 22 on a pivot arm 24 through a drive mechanism 26, all in a manner commonly known to the petroleum industry.

The tee 14 is connected to the oil discharge line 16 through a feed pipe 28 and a coupler 30. The feed pipe 28 has a valve 32 which controls the oil flow. A bleed line 33 feeds out of the other side of the tee 14 and is controlled by a bleed valve 34.

My leak retriever 10 has a reservoir 36 which mounts below the packing gland housing 38 on the top of the tee 14 and below the packing gland cap 40. The reservoir 36 is generally cylindrical and is formed in two semi-cylindrical parts 42. Flanges 44 are provided on each of the parts 42 which project below the reservoir bottom 46 and have the proper configuration to clamp the parts together about the perimeter of the tee 14 (see FIG. 3). Gaskets are provided between the flanges 44 and the tee housing 38 so that when the reservoir 36 is clamped to the tee 14 by bolts 48, no leakage can occur. The wall of the reservoir 36 is formed by a peripherial upstanding flange 50.

Two holes are provided in the bottom 46 of the reservoir 36, both radially offset from the packing gland housing 38. The first is a mounting hole 52 in which a retriever pump 54 is mounted (see FIG. 4). The retriever pump 54 has an elongated housing 56 with a bore 58 which carries a piston rod 60. The pump housing 56 is mounted in the mounting hole 52 by a mounting sleeve 55 and disposed in parallel spaced alignment with said polish rod 20. The mounting sleeve 55 is sealed to the bottom 46 of the reservoir by a weld 62.

The second hole is a drain hole 64. The drain hole 64 has a nipple 66 welded in it which extends downwardly below the reservoir bottom 46 to feed reservoir leakage oil to the retriever pump 54 in a manner hereafter more fully described.

With the reservoir 36 thus mounted, any oil which leaks through the packing gland cap 40 around polish rod 20 passes downward into the reservoir over the outside surfaces of the cap and the housing. Should any oil leak out the bottom of the cap 40 where it is threaded onto the packing gland housing 38, which is quite rare, that also would be captured by the reservoir 36.

The purpose of the retriever pump 54 is to retrieve the leakage oil collected by the reservoir 36 and deliver it into the oil discharge line 16.

As best seen in FIG. 4, the housing 56 passes through the mounting sleeve 55 and is sealed against axial leakage in the sleeve by a threaded collar 68. Axial movement of the housing 56 in the mounting sleeve 55 is restricted by a brace 69 which extends upward from the well head adjacent the pump 54.

At its upper end the housing 56 has a spring flange 70 which supports the lower end of a compression spring 72 disposed about the upper end of the piston rod 60. The upper end of the spring 72 engages a spring collar 74 which is secured at the upper end of the piston rod 60 at this point. When the piston rod is driven downward by means later explained, the spring 72 is compressed between the spring flange 70 and the spring collar 74 and when the piston rod is released the spring 72 drives it upwardly again. To prevent leakage about the piston rod 60 and the upper portion of the housing 56, a pump cap 73 is threaded on the upper end of the housing with packing material 75 captured therebetween.

At the lower end of the housing 56 of the retriever pump 54, a pump tee 76 is threadedly attached. One way check valves are connected to each branch of the tee 76, the first being inlet valve 78 and the second outlet valve 80.

A pump chamber 82 is formed in the lower end of the housing 56 between the lower end of the piston rod 60 and the two check valves. Thus, when the piston rod 60 is drawn upward, oil is sucked into the chamber 82 from the reservoir 36 through a retriever feed line 84 and when it is driven downward the oil in chamber 82 is forced outward through outlet valve 80 in retriever outlet pipe 86.

The retriever outlet pipe 86 connects to the oil discharge line 16 via the feed pipe 87. A pressure gauge 88 is provided in the feed pipe so that pumping conditions can be observed and a feed pipe valve 90 is located in the line for shutoff when desired.

To drive the retriever pump 54, I mount a driver plate 92 on the polish rod adjacent the upper end of the piston rod 60. The drive plate 92 has a circular bottom plate 94 of sufficient radius that extends well beyond the radial spacing between the polish rod 20 and the piston rod 60. The drive plate has a split center hub 96 which is mounted to the bottom plate 94 by web flanges 98. The bottom plate 94, center hub 96, and web flanges 98 are so arranged that the drive plate 92 can be separated into two parts for assembly on the polish rod 20. When the drive plate is assembled to the polish rod 20, the rod passes through the center hub and the drive plate is clamped to the hub by bolts 100.

The drive plate is clamped to the polish rod at a point which will assure its striking and driving the piston rod 60 to about the bottom of the chamber 82 when the polish rod 20 reaches the bottom of its down stroke. On the upstroke of the polish rod the drive plate will leave contact with the piston rod and the piston rod will be returned to its uppermost position by the compression spring 72, since the stroke distance of the polish rod 20 is considerably greater than that of the piston rod 60 (see FIG. 2).

In FIGS. 5 and 6, I show an alternate form of my invention. My alternate form has a reservoir 104 which is formed of a cylindrical main reservoir chamber 106 welded onto a formed integral with the packing gland cap nut 40 with sides 108 which extend upwardly therefrom utilizing the top of the cap nut as its bottom. To provide mounting room for the retriever pump 54 an auxiliary reservoir chamber 110 is formed on one side of the main reservoir 104. The auxiliary reservoir chamber 110 has a mounting sleeve 112 formed integral with it in which the housing 56 of retriever pump 54 is mounted. The bottom of the mounting sleeve 112 is threaded to accommodate the cap 68 which seals the housing 56 in the sleeve.

The auxiliary reservoir chamber 110 opens into the main reservoir chamber 106 through an opening 114 so that any fluid leaked by the retriever pump 54 is also collected in the reservoir 104.

As best shown in FIG. 6, the feed line 84 in this form connects to the reservoir 104 through reservoir port 116. Also, since it is necessary to assemble the reservoir 104 with the cap nut 40 and polish rod 20 if they are not formed together and are to be made integral by welding, I made my main reservoir chamber 106 with a removable wall section 118. Removal of this wall section 118 leaves a gap sufficient to pass the polish rod 20 and permit the main reservoir chamber 106 to be positioned over the cap nut 40 in axial alignment with the polish rod 20. The wall section 118 is then replaced and welded to the reservoir walls 108, and the lower edges of the walls 108 are welded to the top of cap nut 40. Otherwise, my alternate embodiment is constructed and operates the same as the first embodiment.

If desired, my retriever permits total concealment of the upper end of the well pipe and the packing gland in a housing. To prevent wind from blowing the leaking oil off the cap nut 40 before it reaches the reservoir 36 in my first embodiment, a split cylindrical shield 120 with a diameter slightly less than that of the reservoir is placed about the retriever pump and cap nut and clamped by flanges 122 and bolts 124. Ports 126 are provided in the lower portion of the shield so that leakage oil can pass into periphery of the reservoir.

OPERATION

Having described the alternate forms of my preferred embodiment, I will now describe its operation.

After the reservoir 36 and retriever pump 54 have been properly mounted, the feed line 84 is connected to deliver fluid collected by the reservoir to the inlet of the pump. The outlet of the retreiver pump is connected into the oil discharge line 16 and the pump piston rod 60 is disposed upwardly parallel to the polish rod 20. The drive plate 92 is then positioned on the polish rod 20 so that it will strike the piston rod 60 on each stroke and drive it downwardly in the pump chamber 82.

As the well pump operates, fluid leaking about the packing gland flows into the reservoir. On each stroke of the polish rod, the retriever pump is actuated and pumps the fluid collected in the reservoir back into the oil discharge line 16. If the retriever pump leaks during this operation the leakage is collected by the reservoir the same as leakage from the packing gland.

If disconnection of the leak retriever is desired, this is done by merely removing the drive plate 92 from the polish rod 20 or moving it up on the polish rod to a position where it does not strike the piston rod 60 on reciprocation.

From this detailed description of my preferred embodiment it should be understood that my invention is fully capable of achieving the objects and providing the advantages which I have heretofore attributed to it.

When my invention is utilized on an oil well pump the only leakage seen is that passing from the gland down into the reservoir. This leakage does not reach the ground where it would pool or run off but is retrieved into the oil well discharge line. By proper design my retriever pump can discharge oil into nearly any discharge line condition since it is capable of high discharge pressures.

Moreover, my invention is driven from the well pump drive mechanism, and therefore requires no separate source of power. It saves oil, and greatly reduces the maintenance of packing glands because the glands can be run looser since reasonable leakage is no problem and, in fact, becomes an advantage in that it better lubricates the polish rod.

Thus, by retrieving leakage rather than by attempting to save oil and oil mess, my invention more than pays for itself in maintenance savings.

I claim:

1. In an oil well pump having a well pipe with an upper discharge end, a sucker rod reciprocally disposed in said well pipe, a drive mechanism for driving said pump, a packing gland on the upper discharge end of said well pipe, a polish rod interconnecting said sucker rod and said well pump drive mechanism and reciprocally disposed in said packing gland, and an oil discharge line connected in fluid communication with said upper discharge end of said well pipe, a packing gland leak retriever comprising:

a reservoir operatively associated with said packing gland and disposed to collect any fluid leaking therefrom;

a reservoir pump operatively associated with said reservoir and disposed with respect thereto so that any fluid leaked by said retriever pump is collected by said reservoir, and having a fluid inlet and a fluid outlet;

an inlet conduit interconnected between said reservoir and said fluid inlet of said retriever pump to deliver fluid collected by said reservoir to said pump;

an outlet conduit interconnected between said fluid outlet of said retriever pump and said oil discharge line to deliver fluid from said pump into said oil discharge line; and drive means for driving said retriever pump including a drive member attachable to said polish rod for reciprocation therewith, and an elongated rigid substantially vertical driven member having resilient bias means interconnected therewith and disposed to urge said driven member upward, said driven member being engageable by said drive member and movable downward upon downward movement of said polish rod.

2. A packing gland leak retriever as described in claim 1, in which:

said retriever pump is a positive displacement pump with a housing having a barrel disposed substantially parallel to said polish rod and a pump rod reciprocally movable in said barrel, and said pump housing is mounted in said reservoir;

said barrel and pump rod being so coordinated as to pump fluid into said oil discharge line from said outlet conduit at a pressure higher than the pressure in said oil discharge line; and said resilient bias means of said drive means includes spring means interconnected between said pump rod and said pump housing and disposed to resilently urge said pump rod upwardly in said barrel.

3. A packing gland leak retriever as described in claim 1, in which:

said retriever pump includes a mounting sleeve affixed in said reservoir in substantially parallel alignment with said polish rod and extending through the bottom thereof, a bored pump housing disposed in said mounting sleeve, a bottom bored packing cap threadedly engaged with the bottom of said mounting sleeve and disposed with its bore surrounding said pump housing, a pump rod disposed in said pump housing bore and reciprocally movable therein, said rod having an upper portion extending above said pump housing, and a top bored packing cap threadedly engaged with the top of said pump housing; and said drive means includes a spring cap mounted on said upper end of said pump rod in spaced relationship with the top of said pump housing, and a compression spring disposed about the upper end of said pump rod and captured between said pump housing and said spring cap, and said drive member is disposed to engage the top of said piston rod and drive said rod downwardly in said pump housing bore against the resilient urging of said compression spring.

4. In a packing gland for providing a seal between a reciprocally movable member and a stationary member, a leak retriever comprising;

means defining a reservoir operatively associated with a first of said packing gland members and disposed to collect fluid breaking from said packing gland;

a retriever pump with an inlet channel interconnected in fluid communication with said reservoir means and an outlet channel;

drive means for driving said retriever pump to pump fluid from said inlet channel to said outlet channel, said drive means including a first drive member mechanically interconnected with said reciprocating member for reciproal movement therewith, a second drive member interconnected with said retriever pump and disposed to operate said pump when reciprocated, and operating means including said first drive member disposed to engage and reciprocate said second drive member.

5. A packing gland leak retriever as described in claim 4, in which:

said reservoir is mounted to surround said stationary member of said main packing gland;

said retriever pump is a reciprocally operated piston pump with a piston rod extending therefrom through a retriever pump packing gland, and is interconnected with said reservoir so that any fluid leaking from said retriever pump packing gland is also collected by said reservoir in the same manner as fluid leaking from said main packing gland; and said drive means includes a mechanism interconnected with the movable member passing through said main packing gland and disposed to engage and reciprocate said retriever pump piston rod.

6. A packing gland leak retriever as described in claim 5, in which:

said main packing gland has its axis disposed substantially vertically and is disposed to form a fluid seal between a housing member and a rod member reciprocally movable vertically relative to one another;

said reservoir includes a pan disposed below said packing gland seal and mounted on a first of said members;

said retriever pump has its axis disposed substantially parallel to the axis of said packing gland; and is mounted in said pan; and said interconnecting mechanism of said drive means includes a drive plate affixed to the second of said members and disposed to engage said piston rod as said member relatively reciprocates.

7. In an oil well pump packing gland providing a seal between the vertically reciprocating polish rod and the well head and oil discharge line, a leak retriever comprising:

a reservoir disposed in surrounding relationship with said packing gland and disposed to collect fluid leaked from said packing gland;

a retriever pump mounted on said packing gland and disposed in fluid communication with said reservoir and having a retriever pump plunger reciprocally movable in a retriever pump cylinder, said retriever pump being actuatable upon reciprocation of said retriever pump plunger in said retriever pump cylinder to pump fluid out of said reservoir; and drive means for actuating said retriever pump including a platen affixed to the polish rod and disposed to engage said retriever pump plunger and drive said plunger downward into said retriever pump cylinder on a power stroke upon reciprocation of said polish rod in a downward direction and disengage from said retriever pump plunger upon reciprocation of said polish rod in an upward direction, and resilient bias means interconnected between said retriever pump plunger and said retriever pump cylinder and disposed to urge said retriever pump plunger upwards out of said retriever pump cylinder, on a return stroke.

8. A packing gland leak retriever as described in claim 7, in which:

said reservoir is a generally cylindrical pan removably clamped below said packing gland in surrounding relationship thereto and has upstanding sides which extend upward about said packing gland.

9. In an oil well pump packing gland leak retriever as described in claim 7, in which:

said retriever pump includes an output channel connected to the oil discharge line of said well head and a check valve disposed in said output channel to block fluid backflow therein from said oil discharge line to retriever pump, and said retriever pump plunger, retriever pump cylinder, and retriever pump power stroke cooperate to dispense fluid from said retriever pump into said output channel at a pressure greater than the fluid pressure in said oil discharge line.

* * * * *